United States Patent [19]

Lee et al.

[11] 4,019,734

[45] Apr. 26, 1977

[54] ELASTIC PULL TYPE ISOTONIC/ISOMETRIC EXERCISER

[76] Inventors: Wayne Lee, 814 N. Delaware, No. 301, San Mateo, Calif. 94401; John Richardson, Rte. 2, Box 680-79, Sonora, Calif. 95370

[22] Filed: July 31, 1975

[21] Appl. No.: 600,161

[52] U.S. Cl. ..... 272/137; 272/143

[51] Int. Cl.[2] ..... A63B 21/02

[58] Field of Search ..... 272/82, 79 R, 80, 75, 272/135, 137, 139, 142, 143, 136; 128/327

[56] References Cited

UNITED STATES PATENTS

| | | | |
|---|---|---|---|
| 1,566,235 | 12/1925 | Sheehan | 128/327 |
| 2,723,125 | 11/1955 | Cartwright et al. | 272/75 |
| 2,930,614 | 3/1960 | McIntosh | 272/82 |
| 3,138,377 | 6/1964 | Stewart | 272/75 |
| 3,677,543 | 7/1972 | Richardson | 272/82 |

FOREIGN PATENTS OR APPLICATIONS

| | | | |
|---|---|---|---|
| 562,787 | 10/1932 | Germany | 272/82 |

*Primary Examiner*—Richard C. Pinkham
*Assistant Examiner*—William R. Browne
*Attorney, Agent, or Firm*—Robert C. Colwell

[57] ABSTRACT

An elastic resistance type exercising device having a single length of latex rubber surgical tubing whose two ends are formed into size handle loops by the use of leather fasteners. The handle loops are sleeved with vinyl tubing, and plugs are inserted in each of the open ends of tubing, that have twice passed through the fasteners to form the loops, to prevent the tubing from being pulled out of the fasteners. A user grasps the handle loops or secures them about his ankles and pulls against the elastic resistance. Two additional flexible sleeves are slidably mounted over the portion of the elastic tubing between the fasteners.

1 Claim, 5 Drawing Figures

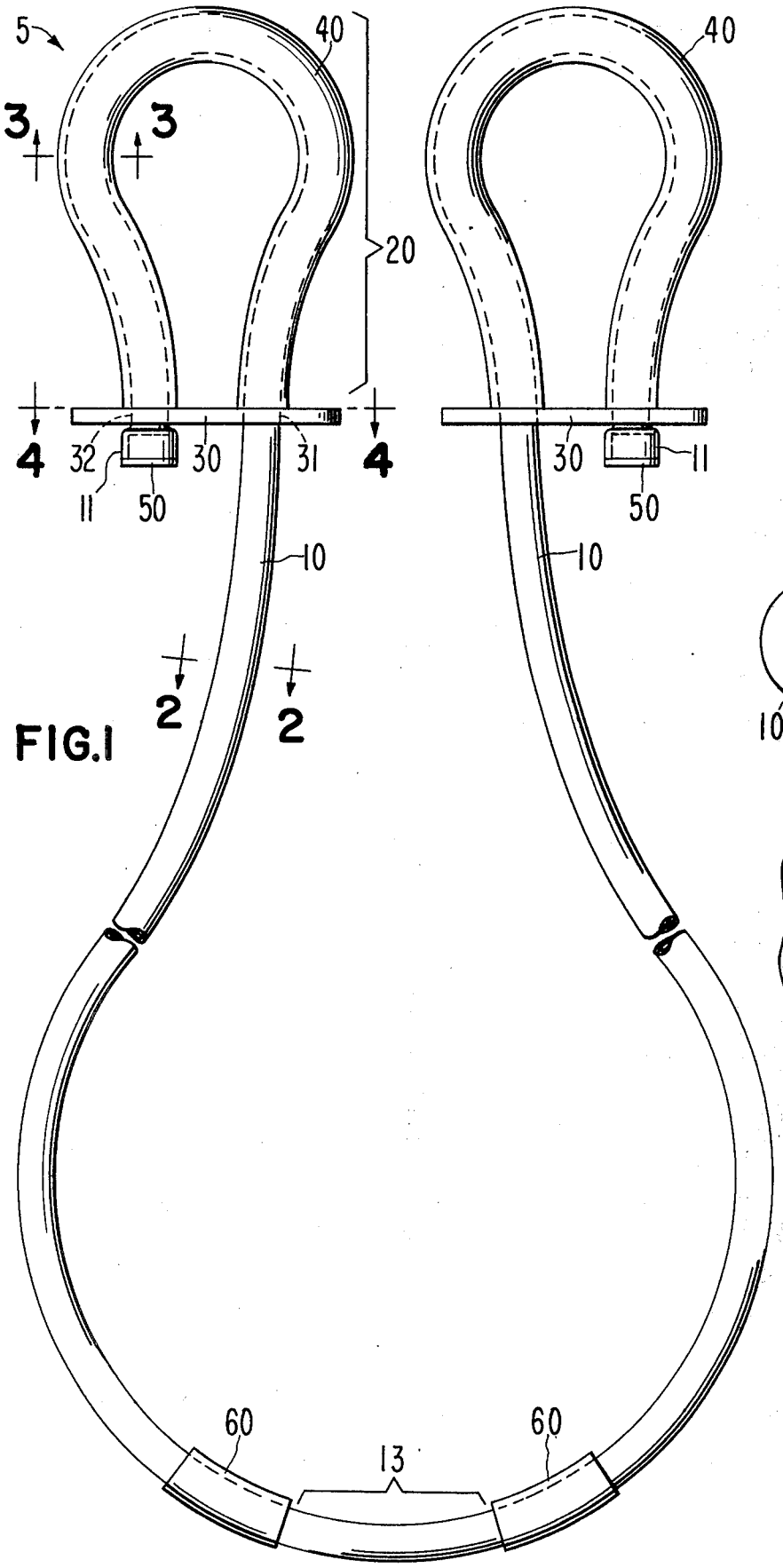
FIG.1
FIG.2
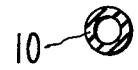
FIG.3
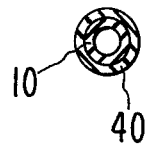
FIG.4
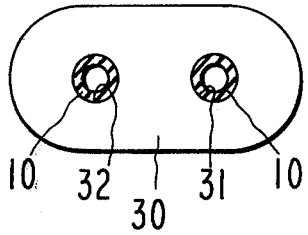
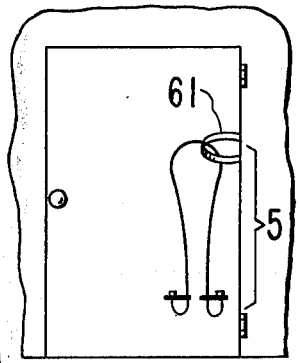
FIG.5

ELASTIC PULL TYPE ISOTONIC/ISOMETRIC EXERCISER

BACKGROUND OF THE INVENTION

1. Field of the Invention:

This invention relates to a portable elastic exercising device with adjustable size handles, and an adjustable resistance elastic member, typically latex rubber surgical tubing.

2. Description of the Prior Art:

Single piece elastic exercising devices are known in the art, and have been the subject of several patents. For example, U.S. Pat. No. 3,415,515 entitled *RUBBER CORD SKIPPING ROPE AND EXERCISER* and issued to Otto discloses a skipping rope and exerciser formed of standard rubber cord encased in a fabric sheath with loops formed at each end. U.S. Pat. No. 3,838,852, entitled *ELASTIC TYPE EXERCISING DEVICE* and issued to Gury discloses a one piece resiliant single strand exerciser having loops molded into each end.

The present invention relates to improvements in U.S. Pat. No. 3,677,543 entitled ELASTIC PULL TYPE EXERCISER and issued to Richardson. Therein is disclosed a pull type exercising device comprised of a single piece of elastic tubing having a slidable ring mounted thereon, and having loops formed at each end of the tubing by S-shaped hooks to receive the folded ends of the tubing.

SUMMARY OF THE INVENTION:

A portable elastic exercising device is formed from one piece of elastic material with handle loops of adjustable size being formed at each end of the elastic material. A sleeve is placed on each looped portion of the elastic material, and the handle loop is secured by a fastener having two holes therein. The elastic material is passed through the first hole, then through the second hole, and secured.

One primary object of this invention is the utilization of the elastic characteristics of latex rubber surgical tubing in a portable exercising apparatus. This apparatus may be conveniently and diversely used for strengthening many muscles of the body, for quickening muscle reactions, for toning muscles, for enlarging muscles, for developing various muscle groups, for reducing body fat, for improving the user's cardiovascular condition, and for improving one's level of physical endurance. In addition to its use for performing most conventional exercises, this invention also may be used to develop specific muscle groups most commonly used in various athletic activities such as golf, tennis, swimming, skiing, soccer, karate, track and field, and many others, and it is applicable to physical therapy.

This invention provides adjustable handle loops superior to those of the prior art. The loop size of the invention may be quickly and easily altered to accommodate different size hands and ankles, and for convenience in placing over the foot when secured around the ankles for lower body exercises. Changing the loop size of prior art devices was often cumbersome and time-consuming, a significant drawback to any exercise program involving different portions of the body.

Unlike many prior art devices, this invention provides handle loop fasteners which may be constructed of leather, vinyl, or other flexible materials. The absence of rubbing between the fastener means and elastic material causes significantly less wear to the elastic material than prior art rigid fasteners, a factor critically important with regard to safety and durability of the exerciser.

One embodiment of this invention also provides pliable plastic, vinyl tubing, or other suitable material handles sleeved over the looped ends of the rubber tubing. These sleeves are superior in comfort, durability, economy, and safety to the prior art devices utilizing a farbic sleeve handles which required the process of sewing a seam. Utilizing soft plastic tubing for the sleeves also provides non-slip, comfortable substance for grasping with the hand, placing around the bottom of the foot in the manner of a stirrup, or securing around the ankle. Further, unlike many prior art devices, sleeves utilizing plastic tubing are sufficiently rigid to provide a non-binding grip.

One embodiment of this invention utilizes open-ended plastic stoppers for insertion into the ends of the handle loops to prevent the elastic material when it is latex tubing from pulling out of the handle loop fasteners. This method of securing the handle loops is superior in appearance and ease of manufacture to prior art devices which utilized sleeve or knot. The prior art devices also prevented the free passage of air through the elastic material when it is tubing, a factor that may reduce the life of the tubing. The free passage of air through the tubing also prevents increases in air pressure inside the tubing which might expell any solid plug.

This invention also allows the provision of varying degrees of resistance against which the user of the exerciser may pull by utilizing (1) different lengths of elastic material, (2) different wall thicknesses and diameters, and (3) different user positions (closer to the point of attachment of the exerciser for light resistance and further from point of attachment for greater resistance).

This invention also provides for a convenient and safe manner of securing the exerciser for certain exercises. A strap of suitable material, for example, nylon or polypropylene webbing, can be used to attach the exerciser to a stationary object. The elastic material will then be in direct contact with the webbing belt. This causes significantly less wear upon the elastic material than prior art devices such as metal rings, thus providing greater safety and durability. Securing the exerciser with a strap also provides superior convenience and versatility of use to prior art devices as the exerciser may be secured through the door jam of a closed door so the user may place the belt at any desired elevation for performing various exercises.

This invention may be used isometrically as well as isotonically. A vast array of exercises can be performed with this invention whether the exerciser is secured with a strap or belt to an object, or whether the exerciser is affixed around the feet and pulled with the hands, or just pulled with the hands. One may exercise the lower body by, among other exercises, securing the loop handles around the ankles to do leg raises, leg crossovers, lateral leg lifts, leg curls, leg extensions, and run-in-place leg pull downs and bicycling may be performed with the handles used as foot stirrups. Situps, side bends, dead lifts and waistline dips require the hands on the loop handles as do upper body exercises such as arm crossovers, and pectoral flys for development of the chest muscles; frontal raises, military press, pullovers, lateral raises, rowing motion, for front, top, side and back of shoulders. The hands are also in the handle loops for arm curls and forearm curls which are exercises for development of the arm biceps, and triceps. This exerciser is excellent for reducing fat from hips, thighs, waist, back, arms and it can increase the size and/or firm-up the female bustline. People in the medical field will find the exerciser applicable to certain areas of physiotherapy. Body builders can experience enlargement and toning of many muscles and muscle groups. Recreationalists and athletes can benefit from use of the apparatus as resistance can be applied to the user's common muscle movements in his respective sport, such as in golf and tennis arm swings, the leg swings in kicking a soccer ball or a football, the arm strokes in swimming, and the arm and leg movements in karate, judo, or similar activities.

BRIEF DESCRIPTION OF THE DRAWING

FIG. 1 is a plan view of the preferred embodiment of the apparatus.

FIG. 2 is a cross-sectional view of the apparatus shown in FIG. 1 along the line 2—2.

FIG. 3 is a cross-sectional view of the apparatus shown in FIG. 1 along the line 3—3.

FIG. 4 is a cross-sectional view of the apparatus shown in FIG. 1 along the line 4—4.

FIG. 5 is a view of the exerciser as it may be used in a door frame with a securing belt.

DETAILED DESCRIPTION OF THE INVENTION

One preferred embodiment of the exerciser 5 of this invention is shown in FIG. 1. Exerciser 5 comprises a length of elastic or stetchable material 10, handle loops 20, fastener means 30, and sleeve means 40. Elastic material 10 may be of any desired cross-section and length, depending upon the desired stretch and resistance force elastic material 10 is to oppose against a user of the device. In one embodiment, elastic material 10 is latex rubber surgical tubing approximately 6 to 10 feet in length. In some embodiments the tubing has an outside diameter of between 3/16 inch and 1-½ inch with wall thicknesses between 1/32 inch and ¼ inch. The choice of tubing diameter, wall thickness, and length, may be used to provide different degrees of resistance to accommodate the varying levels of strength and conditioning of different users.

Handle loops 20 for handles are formed at each end of elastic material 10. Handle loops 20 are formed by pulling the ends of elastic material 10 through a first hole 31 in fastener means 30. Fastener means 30 may be any suitable material, for example, leather or plastic. Fastener means 30 functions to maintain handle loop 20. The diameter of hole 31 is equal to or less than the outside diameter of elastic material 10.

The desired amount of elastic material 10 is pulled through hole 31 in fastener means 30. Having the desired amount of elastic material 10 extending from hole 31 in fastener means 30, sleeve means 40 are fitted over a selected portion of elastic material 10. Sleeve means 40 will typically be approximately 12 inches of plastic or vinyl tubing, although any desired length and any suitable material may be used. To complete forming of handle loops 20, the end 11 of elastic material 10 is inserted back through fastener means 30 via hole 32.

In some embodiments of the invention, a plug 50 is inserted in the open end of elastic material 10. Plug 50 may be a plastic or vinyl stopper with a shank diameter slightly larger than the inside diameter of elastic material 10, when elastic material 10 is tubing. In this manner end 11 of elastic material 10 is enlarged to prevent end 11 from pulling through hole 32 in fastener 30 when the exerciser 5 is in use and under tension. Plug 50 may be open at each end to allow free passage of air throughout the exerciser 5 when elastic material 10 is tubing. In other embodiments a clip or knot may be used in place of plug 50 to secure end 11.

In one embodiment exerciser 5 is used by placing a strap around the approximate mid-point 13 of elastic material 10. With a strap or belt, the exerciser 5 may be affixed to any suitable object or secured in a closed door.

In some embodiments two pieces of tubing 60 are placed on elastic material 10 prior to the formation of handle loops 20. Tubing 60 has an inside diameter approximately the same as the outside diameter of unstressed elastic material 10. When elastic material 10, however, is stressed, its outside diameter is reduced, and tubing 60 is freely slidable along elastic material 10. Tubing 60 can therefore be used to mark any desired location on elastic material 10. For example, the center point of the length of elastic material 10 can be designated so that repeated adjustments to equalize the force exerted against pulling on each handle are minimized. Further, a user may stand on tubing 60 while doing arm curls, military presses, side bends or other exercises, and in this manner elastic material 10 is not damaged by footwear or the surface upon which exercises are being performed.

FIG. 2 shows a cross-section of a preferred embodiment of elastic material 10, that is, latex rubber surgical tubing.

FIG. 3 shows a cross-section of handle loops 20. In this embodiment, elastic material 10 is latex rubber surgical tubing, while sleeve means 40 is vinyl tubing with an inside diameter slightly greater than the outside diameter of elastic material 10.

FIG. 4 shows a cross-section of the handle loops 20 just above fastener means 30. In one embodiment, fastener means 30 comprises at least two layers of leather.

FIG. 5 shows the exerciser 5 as it may be utilized with a belt 61 to secure it between a closed door and door frame.

In one preferred embodiment of this invention elastic material 10 is latex rubber tubing. Some manufacturers of this tubing, for example, Reichhold Chemicals, Inc., claim it may be elongated up to 900% of its unstressed length and that it has a tensile strength greater than 4,000 pounds per square inch. These properties give rise to extraordinary enduring elasticity as few exercises need be performed with elastic material 10 stretched more than two or three times its relaxed length. Because it is only modestly stressed, the rubber's molecular structure breaks down only minimally with use resulting in a durable device.

When elastic material 10 is latex rubber tubing and fastener means 30 are formed with hard or abrasive substances, the rubber may fracture from friction as it is stretched and relaxed in use. In one embodiment fastener means 30 eliminates this heretofore disadvantage by being formed of leather. This allows the entire length of elastic material 10 to stretch, spreading the tension more uniformly over the full length. Fastener means 30, because it may be flexible, provides safety, ease in size adjustment and convenience in replacing any worn-out parts.

While several embodiments of this invention have been illustrated and described, it will be understood by those skilled in the art that many modifications and changes may be made without departing from the spirit and scope of the invention. For example, the handle loops may be affixed to wooden rods or metal pipe to afford a different grip for users of the exerciser for performing exercises in a different manner.

We claim:

1. An exercising apparatus comprising:

A single length of elastic tubing of substantially constant diameter.

first and second flexible sleeves slidably mounted over opposite ends of the elastic tubing leaving exposed a portion of each end of the elastic tubing, first and second fastener means, each including a sheet of flexible material having two circular holes therethrough, each hole having substantially the same diameter as the elastic tubing, and each fastener means including a plug to expand the diameter of the end of the elastic tubing to prevent it from passing through either hole in the flexible material, wherein one end of the elastic tubing is passed through one hole in one of the sheets of flexible material, one flexible sleeve is slipped onto the elastic tubing, and the exposed portion of the end of the elastic tubing is returned in the opposite direction to the previous passage through the other hole in said flexible sheet of material, and one plug is inserted into the open end of tubing, wherein the other end of the elastic tubing is passed through one hole in the other sheet of flexible material, the other sleeves is slipped onto the plastic tubing, and the exposed portion of that end of the elastic tubing is returned in the opposite direction to the previous passage through the remaining hole in said flexible sheet of material, and the remaining plug is inserted into the open end of the elastic tubing, and wherein two additional flexible sleeves are slideably mounted over that portion of the elastic tubing between the first and second fasterner means.

* * * * *